United States Patent [19]

Seroussi

[11] Patent Number: 4,648,410

[45] Date of Patent: Mar. 10, 1987

[54] NARGILE - ORIENTAL TOBACCO WATER PIPE FOR SMOKING CURED TOBACCOS

[76] Inventor: Henry I. Seroussi, P.O. Box 269, Staten Island, N.Y. 10314

[21] Appl. No.: 756,590

[22] Filed: Aug. 22, 1985

[51] Int. Cl.[4] ..... A24F 1/30

[52] U.S. Cl. ..... 131/173

[58] Field of Search ..... 131/173

[56] References Cited

U.S. PATENT DOCUMENTS

| | | | |
|---|---|---|---|
| 1,513,147 | 10/1924 | Zahariadis | 131/173 |
| 2,911,984 | 11/1959 | Gerard et al. | 131/173 |
| 3,703,179 | 11/1972 | Nubla | 131/173 |
| 4,029,109 | 6/1977 | Kahler | 131/173 |
| 4,134,409 | 1/1979 | McManna | 131/173 |
| 4,140,138 | 2/1979 | Keller | 131/173 |
| 4,161,954 | 7/1979 | Fornaciari | 131/173 |
| 4,253,475 | 3/1981 | Schreder | 131/173 |

*Primary Examiner*—V. Millin

[57] ABSTRACT

A smoking apparatus comprising of an appliance with a pipe bowl to serve as a smoking pipe with means for controlling the thermal conduction around the said pipe bowl, with means for communicating with a layer of water in a releaseably attached liquid-containing receptacle, with means for passage of the outgoing smoke to enter a filtering element removing moisture from the liquid-filtered smoke, which is then drawn into a flexible conduit for smoker's use. The invention takes into account the physical phenomenas of the two contrasting filtration processes and to bring them to a balance. All parts thereof are synchronized for integrating the various functions into one result; to produce a tobacco smoke which is "clean", "sweat", "cool", "dry" without a "bite". The smoker can, without tedious encumbrances change and replace parts that draw contaminants. The invention is an improvement of the centuries old nargile and would serve the needs of the large population, who in contemporary living, stay home for work and pleasure.

15 Claims, 4 Drawing Figures

10
12
14
16
18
20
22
23
24
26
28
30
32
34
35
36
38
40
42
44
45
46
48
50
52
54
56
58
62
64

12A
10A
40A
14A
22A
16A
18A
32A
28A
50A
52A
46A
24A
56A
30A
26A
48A
36A
44A
45A
54A
38A
42A
36A
34A
20A
58A
35A
62A
64A

NARGILE - ORIENTAL TOBACCO WATER PIPE FOR SMOKING CURED TOBACCOS

BACKGROUND OF THE INVENTION

1. Field of the Invention

This invention relates generally to the Art of Smoking Waterpipes and in particular to devices known as Nargile otherwise known as Hookah or Bong. Specifically, the invention relates to an improved apparatus embodying a hand holdable appliance to serve as a tobacco smoking pipe, releasably attached to a water containing receptacle, the related tubular arrangement, the extensions thereof, a filter element, the flexible conduit for the outgoing smoke and a soft mouthpiece. It is an improved dual-filtration system which effectively removes excess moisture and contaminant from the tobacco smoke, producing a "clean", "sweat", "cool", "dry" smoke without a "bite". This apparatus provides an efficient utilitarian function without impairing esthetic values in form, design or color.

2. Description of the Prior Art

The nargile is a centuries old smoking device, heretofore utilized for smoking controlled substances. Generally described, the nargile provides for the smoke produced from burning smokable material in a pipe bowl to be passed through a layer of water. Undesirable smoke by products such as tar, oil, ashes, carbon monoxide and the like are absorbed or separated in the water layer. The nargile was first adapted for smoking tobacco by utilizing a large metal pipe bowl into which was inserted tobacco paste, followed by the application of burning charcoal on top of the tobacco to aid in burning. Later, after the introduction of cigarette tobacco in the Middle East, a much smaller nargile with a smaller pipe bowl emerged. The cigarette tobacco was dry and burned quickly, producing a hot smoke with unsatisfactory results. Cured tobaccos, which burned slowly and cooly because of higher moisture content, became popular with smokers using hand held briar pipes. A controllabe slow burn permitted the smoker to creat a "cake" in the center of the pipe bowl, and thereby develop a more complete burn of the tar, oils and other contaminants in the tobacco with a partial evaporation of moisture. This in turn generated, in smoker's parlance, a "sweat", "cool", and "dry" smoke. If excessive moisture entered the mouthpiece, a "bite" was created, occasioned by the accumulation of material in the mouthpiece which was removable with pipe cleaners.

Cured tobaccos, however, were generally found to be unsuitable for use in prior art waterpipes, because of their inherent moisture content, when combined with the moisture added to the smoke from the waterpipe itself, resulting in cluttering of the outgoing tubular conduits of the device with water droplets, thereby interfering with the control and enjoyment of the smoking activity. In the Middle East, this problem of excessive moisture formation has heretofore been addressed by the introduction of a nargile with an elongated metal tube for the outgoing smoke to travel initially in an upright position so as to force water droplets to drain out from the smoke by gravity. A longer larger flexible conduit for the outgoing smoke would relieve the moisture. This type of device, however, has not been accepted in the United States and Western countries, where the preference is clearly for hand or mouth held dry smoking pipes, in which cured tobaccos in different mixtures, fragrances, tastes and aromas are virtually the only packaged and branded tobaccos presently available in the market place.

During the past 130 years, several prior arts attempted to modify, innovate, invent, add, restructure waterpipes acceptable in the United States or Western Countries, they failed to penetrate the market and none have become popular and acceptable to tobacco smokers. In general, the reason given is that smokers have rejected a stationary smoking apparatus. The invention contends that neither the nargile nor the prior arts, relating to waterpipes, were sufficiently appropriate or fulfilling to tobacco smokers.

There is accordingly, a need in the arts for a waterpipe with the advantages of the traditional nargile, yet allows moisture free tobaccos smoking of cured tobacco in a hand holdable appliance releasably attached on a stationary water-containing receptacle including all the other advantages of the invention.

SUMMARY OF THE INVENTION

It is accordingly an object of the invention to provide a smoking apparatus which passes the smoke through a water layer to remove undesirable by products in tobacco smoke.

It is another object of the invention to provide a smoking apparatus, as above, which can use curred tobaccos.

It is yet another object of the invention to provide a smoking apparatus, as above, which removes excess moisture from the smoke.

It is yet another object of the invention to provide a smoking apparatus, as above, for removal of contaminants which may escape the water layer.

It is still another object of the invention, as above, to provide a hand holdable appliance to serve as a smoking pipe releasable from the water receptacle to clean the pipe bowl and refill with fresh tobacco or change the water.

It is still another object of the invention, as above, to provide a smoking appliance whereby a ceramic pipe bowl is encased in a glazed ceramic truncated cone to confine thermal conduction around the pipe bowl to permit the user, whenever smoking is active, to safely handhold the base of the appliance.

It is still another object of the invention, as above, to provide an appliance with non-toxic bonding material, to hold in place the componants thereof and render said appliance air-tight.

It is another object of the invention, as above, to provide a smoking apparatus which is constructed of replaceable parts which are inexpensive and easily available.

It is still another object of the invention, as above, to provide a smoking pipe where the user can control the burn of tobacco in the pipe bowl.

These objects, as well as other objects of the invention are achieved by the smoking apparatus, as above, comprising of a smoking appliance, where a ceramic pipe bowl receiving and holding tobacco and having a first tubular passage communicating with, and extending from the lowest portion of the bowl, means for removably positioned device in the tubular passage for preventing the tobacco from entering the tubular passage, means for releasably securing the smoking appliance to a water containing receptacle having an air space above the liquid level, the tubular passage extending from the pipe bowl in the direction of the receptacle, the tubular extension extending into the receptacle below the level of the liquid, a filter element fluidly communicating with the air space above the liquid level by means of a second tubular passage attached to the filter element, the filter element containing absorbant filter means for removing moisture and other contaminants, a third tubular conduit attached to the filter element at a location opposite that of the second tubular passage and a soft mouth piece frictionally inserted at the end of the third tubular conduit.

DEFINITIONS REFERRED TO IN THE DESCRIPTION OF THE INVENTION

Figure 1:
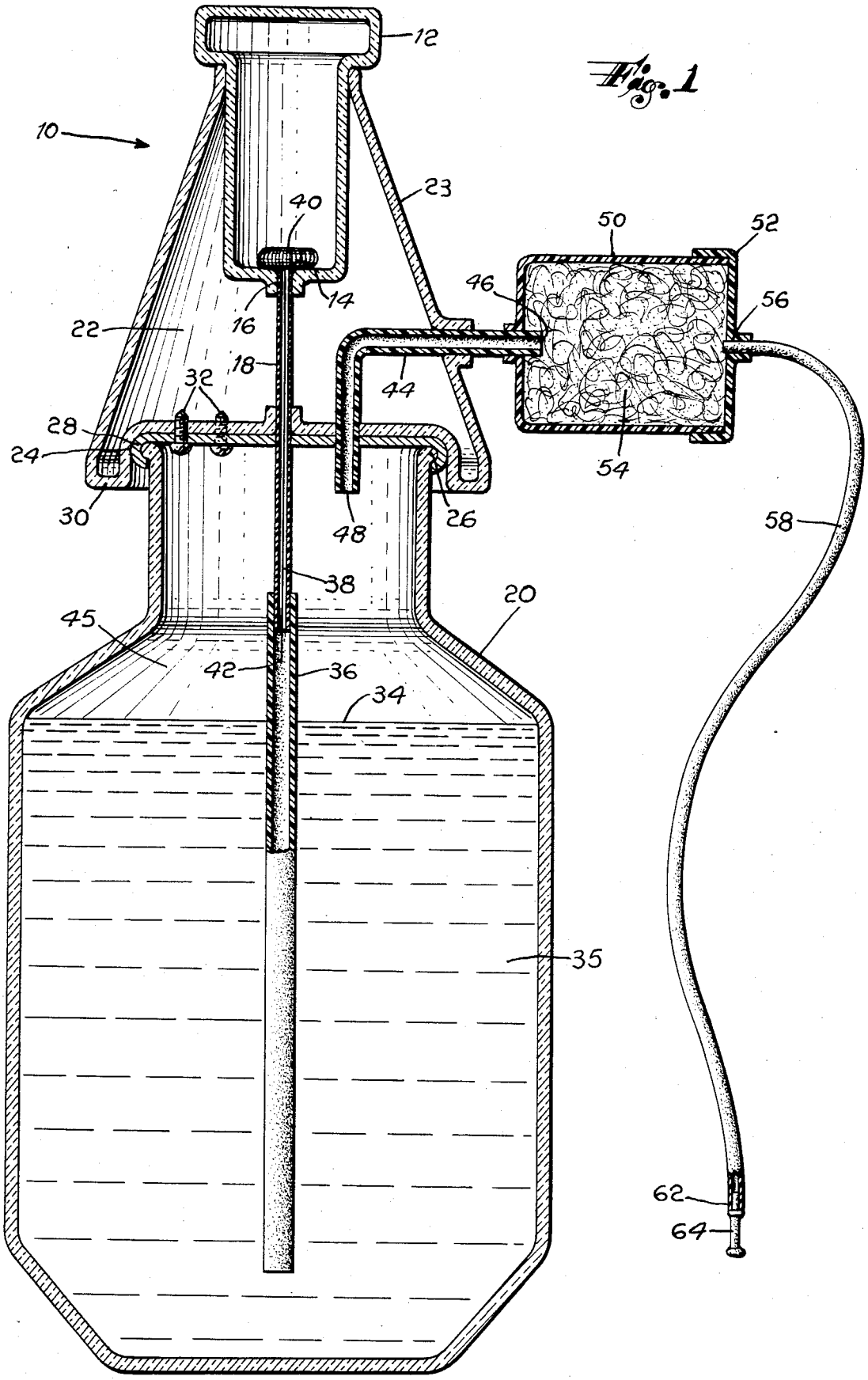
FIG. 1 is a cross-sectional view of one embodiment of the smoking apparatus of the invention.

Smoking Apparatus: A system for smoking cured tobacco with means for dual filtration of the tobacco smoke consisting of the following:

(1) Smoking appliance - a hand holdable glazed ceramic truncated cone to serve as a smoking pipe, mounted at the top: a ceramic pipe bowl with a tubular passage communicating with the water layer in the receptacle, at the base means for releasably attaching to the receptacle, a second tubular passage fluidly connecting the air space above the water level with the filter element.

(2) A portable receptacle containing water which is 4/5 full.

(3) A filter element outwardly angled containing absorbant filtering means.

(4) A flexible conduit to carry the outgoing smoke releasably attached to the filter element and on the other end is frictionally inserted a soft mouthpiece.

DETAILED DESCRIPTION OF THE PREFERRED EMBODIMENTS

The invention is designed and engineered to utilize cured tobacco in an improved nargile or hookah which incorporates the advantages of water filtration with the immediate offset of dry filtration to remove excess moisture, and thereby bring the two processes into balance. In addition to recognizing the advantages of water as the best media for filtration of tobacco smoke, the invention provides for a liquid-containing receptacle of optimum size which effects a thorough cleaning of the tobacco smoke by removing tar, oils, carbon monoxide, ashes and other impurities.

Turning to the figures, in particular, FIG. I, a smoking apparatus according to the invention is indicated by the number 10. The smoking appliance 22, a preferred arrangement involves a hollow, truncated cone 23 made of glazed ceramic. A pipe bowl 12 made of fire resistant unglazed ceramic is placed at the top of the smoking appliance is used for receiving and holding tobacco, an opening 14 at the base of the pipe bowl 16 in which is positioned a tubular passage 18 which extends from the pipe bowl 12. The pipe bowl 12 can be hollow cylindrical, hemispherical or other shapes known to those skilled in the art.

As shown in FIG. 1 the smoking appliance 22 consists of a truncated cone 23 connecting with a receptacle by groove means 24 in the base of the cone which are matingly engageable with groove means 26 in the receptacle 20. The receptacle 20 is preferably a jar, 64 fluid ounces in size, such as a fruit jar or other similar household item, having the grooves 26 along its upper rim. The groove means 24 in the base 30 of the cone can be arranged along the periphery of a lid 28 secured into the base by means of screws 32 or equivalent fastners.

The tubular passage 18 passes through the base 30 and lid 28 and into the receptacle 20 to a point above level 34 of the liquid 35 in the receptacle. Secured to the tubular passage 18 by friction or other suitable means is a tubular extension 36 which extends below the liquid level 34. The tubular extension 36 is preferably constructed of plastic or other inexpensive material such as a plastic straw for sipping beverages which can be discarded and replaced at low cost. The plastic straw is immersed into the liquid and terminates near the bottom of the receptacle.

The second tubular passage 44 also passes through the base 30 and lid 28, and extends into the receptacle 20 to a point in the air space 45 above the liquid level 34 and stands vertically on one end 48. The second tubular passage 44 extends into the truncated cone and is angled towards the opposite end 46 where it is inverted horizontally and extending outward through the cone 23 and receives a filter element 50, which is also poised horizontally.

Filter element 50 is preferably a hollow cylindrical member approximately 1¾ cubic inches having a removable cap 52 at the end opposite that at which the end 46 of the tubular passage 44 is connected. Within the filter element 50 is inserted a filtering means 54 which is sealingly maintained within the element by the cap 52. The filtering means can consist of absorbant filtrous material such as rolled paper, which permits the passage of smoke, but excludes water-droplets, excess moisture and micro-particles which may escape the water layer.

Located in the cap 52 of the filter element 50 is an opening 56 through which is inserted a third tubular passage 58 in the form of a flexible conduit for the outgoing smoke from the filter means 54 to the mouth of the smoker; the flexible conduit 58 can be several feet in length and which at its end 62 is frictionally inserted a soft mouthpiece 64.

Figure 3:
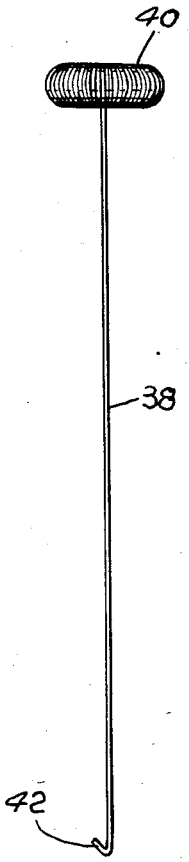
FIG. 3 is a side view of a preferred means for preventing tobacco from leaving the pipe bowl.

As shown in both FIG. 1 and 3, positioned within the tubular passage 18 is a wire 38 having one end which is coiled 40 and resting at the stem of the pipe bowl 16 over the mouth of the opening 14. The coiled end 40 allows smoke to exit the bowl through the tubular passage 18, yet prevents tobacco and some of the ashes from similarly exiting the pipe bowl or congest the tubular passage 18. The wire 38 is removable from the tubular passage 18 and has, as its opposite end, a hook 42 which can be used for cleaning the tubular passage 18.

In an especially preferred embodiment of the invention, the trucated cone 23 is made of durable and heat resistant material such as glazed ceramics. The pipe bowl 12 is made of fire resistant unglazed ceramic and is approximately one inch in diameter and two inches tall. The tubular passage 18 and 44 are made of heat resistant metal or plastic. In order to provide the user with the proper control in burning the tobacco, the ceramic encasement confines thermal conduction around the pipe bowl, thus allowing the smoker to hand hold the base of the smoking appliance safely, when smoking is activated and it is necessary to empty the pipe bowl, refill with fresh tobacco or change the water. In contrast, the traditional nargile is fabricated with bare metal and without thermal control.

The third tubular member 58 is a flexible plastic tube serving as a conduit to the outgoing smoke would preferably be about 3 feet long and ⅜ of an inch in diameter on the outside and 3/16 of an inch inside and is a standard product at hardware and houseware stores.

The mouthpiece 64 is a soft plastic tube approximately one inch and 3/16 of an inch in diameter which can be frictionally inserted into the flexible conduit 58; it is a standard product available at hardware and houseware stores.

Figure 2:
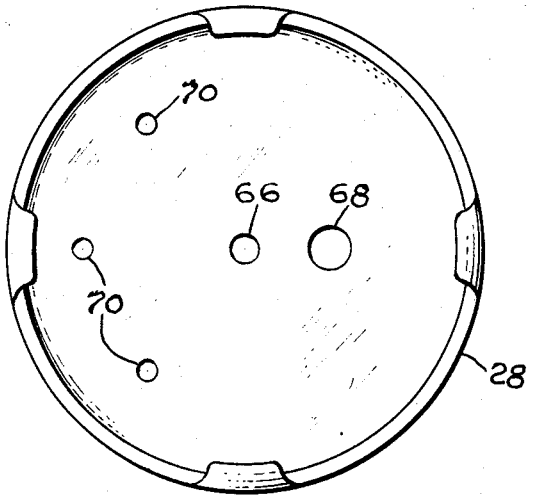
FIG. 2 is a bottom view of one means for securing the water containing receptacle of the invention.

The receptacle or jar 20 is preferrably of a height 10 inches and in diameter 5 inches to contain approximately 64 fluid ounces of liquid which makes it portable. It is a standard product available in food stores and houseware stores. The preferred arrangement in lid 28 in FIG. 2. Apertures 66 and 68 are used, respectively, for insertion of passages 18 and 44. Apertures 70 illustrate the preferred location for insertion of attachment screws 32.

The filter element 50 has an internal volume of about one and three quarter cubic inches.

The smoking apparatus of the invention can be constructed using contemporary industrial techniques and parts, materials and componants to fabricate an inexpensive device. For easy handling and maintenance, the exterior of the pipe appliance is hand washable with soap and water, permitted through the use of glazed ceramic materials. Those portions of the apparatus which become dirtied or contaminated, such as the tubular extension 36, the receptacle 20, the flexible conduit 58 and the mouth piece 64 are easily removed and discarded, to be replaced with parts that can be acquired in variety, houseware, hardware or food stores. These parts do not need additional machining or fabrication to be employed in the invention. All the parts in this apparatus are synchronized to integrate the multitude of functions towards one purpose and one result. Taking into account the physical phenomenas of the two contrasting filtration processes, it is essential to co-ordinate them in harmony and avoid confliction. This will explain why the structure of the invention is different from the traditional nargile or prior arts. It is important to have placed the filter element outwardly and inversely to the water containing receptacle. Placing filtrous material atop the receptacle or using a ready made filter which ordinarily measures ¼ by ½ inch would not serve the purpose. Thus, the emphasis of the invention is on filtration, thorough and complete, in order to remove, as much as possible, materials considered to be health hazards, without hindering the satisfaction of the user.

Effectively, the apparatus produces a "clean", "sweat", "cool", "dry" smoke without a "bite". It permits the user to control and manage the smoking activity, using cured tobaccos which are packaged and readily available in the market place.

The actual operation of the invention will now be described. The smoker ingnites tobacco tamped in the pipe bowl 12 and draws smoke through the mouthpiece 64. Smoke from the burning tobacco passes from the pipe bowl 12 into the tubular passage 18 and the extension thereof 36, and thereafter exits into the water 35 in the receptacle 20 which is 4/5 full, the water absorbs and separates undesirable materials from the smoke. At the same time, the smoke picks up additional moisture. The smoke by gravity moves up to reach the air space 45, it exits the receptacle through the tubular passage 44 and is filtered in filter element 50 to remove the excess moisture and other contaminants. The filtered smoke passes out of the filter element through 56 into the flexible conduit 58 and into the mouthpiece 64.

Figure 4:
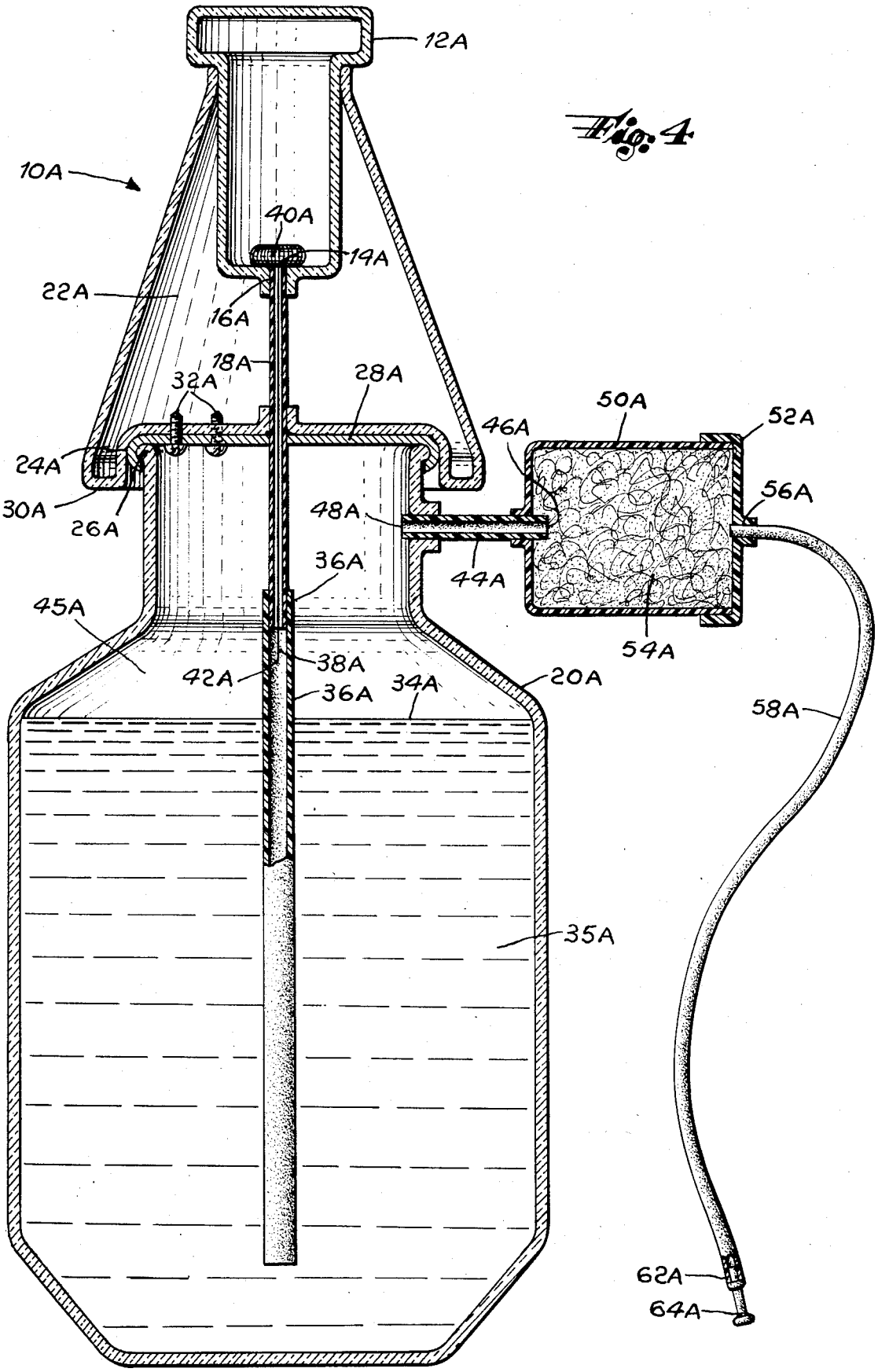
FIG. 4 is a cross-sectional view of a receptacle and filter element of a second embodiment of the invention.

In another embodiment of the invention, illustrated in FIG. 4, a receptacle **20*a*, rather than being an inexpensive item such as a glass jar, is constructed of material such as blown glass, crystal, pottery, china, porcelain and the like which is not intended to be discarded. In this embodiment, the filter element 50*a* may be placed in a horizontal position on the receptacle 20*a* rather than on the cone 23*a* or other means for connecting the smoking appliance 22*a* to the receptacle 20*a*. The filter element 50*a* is placed on the receptacle 20*a* well above the liquid level 34*a*, so that watered filtered smoke is drawn in the same manner as previously described, that is through a tubular passage 44*a*, into the filter element 50*a* and out through the flexible conduit 58*a* and the mouthpiece 64*a***.

The foregoing description of the preferred embodiments has been set forth merely to illustrate the invention and is not intended to be limiting. Since modifications of the described embodiments incorporating the spirit and substance of the invention may occur to persons skilled in the art, the scope of the invention should be limited solely with respect to the appended claims and equivalents.

What is claimed is:

1. A smoking apparatus for smoking cured tobacco, comprising:

an appliance to serve as a smoking pipe with a pipe bowl connected to a first tubular passage communicating with and extending from the lowest portion at the bottom of said pipe bowl;

means for releasably securing said appliance, serving as a smoking pipe, to a water receptacle having an air space above the liquid level, said first tubular passage extending from said pipe bowl in the direction of said receptacle wherein said means for releasably securing said appliance to said receptacle comprises a hollow, truncated cone, said pipe bowl inserted into the truncated end of said cone and said liquid-containing receptacle releasably secured at the base of said cone;

a tubular extension frictionally attached to the end of said first tubular passage opposite said pipe bowl, said tubular extension extending into said receptacle below the level of the water;

a filter element fluidly communicating with said air space above said liquid level by means of a second tubular passage attached to said filter element, said filter element containing a filter means for removing moisture;

the second tubular passage rising vertically from said airspace is inverted outwardly in the direction of the said filter element; and a third tubular passage attached to said filter at a location opposite that of said second tubular passage.

2. A smoking appliance, as claimed in 1, wherein said appliance is secured to said receptacle by groove means at the brim of the receptacle with matingly engageable groove means at the base of the said appliance.

3. A smoking appliance as claimed in claim 1, wherein said pipe bowl is constructed of fire resistant unglazed ceramic.

4. A smoking apparatus as claimed in claim 1, wherein said filter element includes a hollow cylindrical member connected at a first end to said second tubular passage and having a removable cap at a second end opposite first end, said filtering means insertable into said second end and sealingly maintained in said filter element by said cap.

5. A smoking apparatus as claimed in claim 1, wherein the said filter element is made of metal or plastic and has an internal volume of approximately 1.75 cubic inches.

6. A smoking apparatus as claimed in claim 4, wherein said tubular passage is flexible and is secured at one end to said cap and at the other end is frictionally inserted a soft mountpiece.

7. A smoking apparatus as claimed in claim 6, wherein the said third tubular passage is of flexible plastic 3 feet long, ⅜ inch in diameter on the outside and 3/16 inch on the inside, the mouthpiece is one inch and 3/16 inch in diameter.

8. A smoking apparatus as claimed in claim 4, wherein said filter means if constructed of absorbant paper or fibrous substance.

9. A smoking apparatus as claimed in claim 1 in another embodiment the said filter element is connected directly at the upper level and in the air space of the said receptacle instead of the said smoking appliance.

10. a smoking appliance as claimed in claim 1, wherein the said truncated cone is constructed of glazed ceramic.

11. A smoking appliance as claimed in claim 1, wherein the said jar lid is secured to said base by a plurality of screws engageable with said base.

12. A smoking appliance as claimed in claim 1, wherein means for preventing the tobacco from entering said first tubular passage includes a wire coiled at one end and a hook at the other, wherein, the coiled end rests at the stem of the pipe bowl and the other end is inserted into the first passage.

13. A smoking apparatus as claimed in claim 1, wherein the said tubular extension is frictionally attached to the end of the first tubular passage is a plastic straw.

14. A smoking appliance as claimed in claim 1, wherein the said pipe bowl, the first tubular passage, the second tubular passage and the lid are secured in the said truncated cone with non-toxic bonding material.

15. A smoking appliance as claimed in claim 1, wherein said means for releasably attaching the appliance to the said receptacle is a lid matchingly grooved to receptacles, wherein the internal volume is 64 fluid ounces.

* * * * *